United States Patent [19]

Linder et al.

[11] Patent Number: 4,932,376

[45] Date of Patent: Jun. 12, 1990

[54] CONTROL SYSTEM FOR THE TRANSIENT OPERATION OF AN INTERNAL COMBUSTION ENGINE

[75] Inventors: Ernst Linder, Mühlacker; Martin Klenk, Backnang; Winfried Moser, Ludwigsburg, all of Fed. Rep. of Germany

[73] Assignee: Robert Bosch GmbH, Stuttgart, Fed. Rep. of Germany

[21] Appl. No.: 301,022

[22] Filed: Jan. 24, 1989

[30] Foreign Application Priority Data

Jan. 27, 1988 [DE] Fed. Rep. of Germany ..... 3802274

[51] Int. Cl.[5] ..... F02D 43/04

[52] U.S. Cl. ..... 123/422; 123/423; 123/492; 123/493; 123/416; 123/486; 364/431.07; 364/431.12

[58] Field of Search ..... 123/422, 423, 492, 493, 123/416, 417, 480, 486, 489, 425, 419, 435, 436; 364/431.07, 431.12, 431.05, 431.08

[56] References Cited

U.S. PATENT DOCUMENTS

| | | | |
|---|---|---|---|
| 4,143,622 | 3/1979 | Klötzner et al. | 123/492 |
| 4,416,237 | 11/1983 | Aoki et al. | 123/489 |
| 4,732,125 | 3/1988 | Takizawa | 123/422 |
| 4,827,937 | 5/1989 | Kohler et al. | 123/417 |

*Primary Examiner*—Andrew M. Dolinar

*Attorney, Agent, or Firm*—Walter Ottesen

[57] ABSTRACT

A known control system for adjusting the lambda value of an internal combustion engine includes a corrective value ROM for transient operation wherein corrective values are stored for correcting the injection times for transient operation. In contrast thereto, the system according to the invention includes a corrective base value ROM 30, an adaptation value RAM 35 and an adaptation unit 34. The values from the corrective base value ROM are not utilized directly for correcting injection times; instead, these values serve as corrective base values which only become adapted corrective values by means of multiplication with adaptation values. The adaptation unit adapts the adaptation values in the adaptation value RAM. For this purpose, the adaptation unit determines the lambda value control deviations during a transient operation. If a control deviation is established, then the adaptation unit supplies a change value which is so dimensioned that an adaptation value, which is present for the monitored transient operation, is so corrected that for the next occurrence of a transient operation having the same initial operating conditions, only a smaller control deviation should occur and in the ideal case no such control deviation should occur. The control system according to the invention makes it possible to obtain very low toxic gas quantities also during a transient operation.

18 Claims, 5 Drawing Sheets

CONTROL SYSTEM FOR THE TRANSIENT OPERATION OF AN INTERNAL COMBUSTION ENGINE

FIELD OF THE INVENTION

The invention relates to a control system for adjusting an operating variable of an internal combustion engine during transient operation with the operating variable being utilized as an actuating variable.

BACKGROUND OF THE INVENTION

A control system of Robert Bosch GmbH is widely sold in the marketplace under the name MOTRONIC which is used to adjust especially the ignition angle ZW and the injection time ti. Details of this system are discussed with respect to FIGS. 1 and 2 insofar as they are pertinent to the present invention.

The description of FIG. 1 follows in reference to the adjustment of the injection time ti for steady-state operation. From a precontrol value ROM 20, preliminary injection times tiv are addressed via values of address operating variables, namely, the speed n of the internal combustion engine 21 whose air charge L and engine temperature Tw are read out and transmitted to a corrective logic combining unit 22 which is multiplied by a corrective value K=1 for the steady-state case. The value of the preliminary injection time tiv which is thereby unchanged is supplied to a control logic combining unit 23 which performs a multiplicative logic operation with a control factor FR which is supplied from a control unit 24. In this way, a value of injection time ti is obtained. The control unit 24 determines the control factor FR from the difference of a lambda actual value and a lambda desired value. The lambda actual value is supplied by a sensor unit 25 and the lambda desired value is read out from a desired value ROM 26 when addressed via the above-mentioned addressing operating variables.

If the ignition angle ZW is to be determined in lieu of the injection time ti, preliminary ignition angles ZWv are stored as precontrol values and, instead of the described multiplicative logic combinations, additive logic combinations are performed. The corrective addend for steady-state operation is then 0. The control variable is then the combustion condition VL in lieu of the air ratio lambda.

A status recognition device 27 having a selector switch 28 and a corrective value ROM 29 are shown below the dashed line in FIG. 1. In the corrective value ROM 29, transient-corrective functions f(Z) of actuating variables are stored and are addressable via values of the above-mentioned addressing operation variables and values of the load change dL/dt and the number (Z) of suction strokes since a suction stroke Z=0. The suction stroke having the number Z=0 is that stroke at which the status recognition device determines that the load change dL/dt has exceeded a certain threshold value. As a consequence thereof, the status recognition device 27 delivers a transient signal which sets the number value Z to 0 and which actuates the selector switch 28 such that this switch then connects the corrective value ROM 29 with the corrective logic combining unit 22.

An actuating value transient corrective function as it is stored in the corrective value ROM 29 is shown in FIG. 2. The function comprises a sequence of corrective values K(Z) which in the example is a sequence of N=16 values. The number N of the stored values is dependent primarily on what kind of sensor is utilized for measuring the load changes. If a relatively sluggish sensor is utilized, for example, a suction-pressure measuring device, then N can be 32 instead of 16. The corrective values K(Z) decrease with an increasing number Z of suction strokes. In the example, for Z=15, the corrective value "1" for the multiplicative logic is obtained. This value "1" can be first reached when Z=N=16; however, it can also be reached earlier. The amount of the largest corrective value K(1) and the course of the corrective values is dependent on the values of the addressing operating variables at the point in time of the occurrence of the transient signal, that is, at the point in time at which Z=0. Correspondingly, the addressing operating variables are indexed at the corrective value ROM 29 in FIG. 1 with the number "0".

With the MOTRONIC system, the above-mentioned memory and units are part of a microcomputer. For the entire further description, it applies that the memory and function units are advantageously verified by means of a microcomputer. In contrast thereto, sensors and actuators are typical discrete components.

A disadvantage of the control system already described is that the corrective function f(Z) stored in corrective value ROM is are determined for all engines of a specific series without consideration being made for tolerances within a series and without consideration for aging effects.

SUMMARY OF THE INVENTION

It is an object of the invention to improve a control system of the kind described above that takes tolerances of engines within a series as well as aging characteristics into consideration.

The control system of the invention is for adjusting an operating variable of an internal combustion engine during transient operation with the operating variable being utilized as an actuating variable. Two principle embodiments of the control system according to the invention are disclosed. The first embodiment of the control system includes: a status recognition unit for detecting whether transient operation is present from a starting time point and for supplying a transient signal at the time point, the status recognition unit making the detection in dependence upon the value of the change (dL/dt) of a load-dependent operating variable (L); a precontrol value ROM for storing precontrol values (tiv, ZWv) of actuating variables with the precontrol values (tiv, ZWv) being specified for steady-state operation and which are addressable via values of addressing operating variables (L, n, Tw); a desired value ROM for storing desired values for an operating variable utilized as a control variable (Lambda, VL) with the desired values being specified for the transient operation and being addressable via values of addressing operating variables (L, n, Tw); a corrective base value ROM for storing transient corrective base functions of actuating variables with the corrective base functions being addressable via values of addressing operating variables (L, dL/dt, n, Tw; Z); a corrective value RAM for modifiably storing the transient base functions of actuating variables for the time-dependent determination of corrective values, the transient base-functions being retrieved in an initialization operation from the corrective base value ROM for respective corresponding values of addressing operating variables; an adaptation unit for obtaining change values (DA) from the magnitude of control deviations between actual values of control variables determined during the duration of a transient operation and also from the magnitude of desired values of control variables read out of the desired value ROM; an adaptation logic combining unit for logically combining a value (W) read out of the corrective value RAM with a change value (DA) for obtaining an adapted value (Wnew), which is then stored under the same address in the corrective value RAM with which the previous value was read out; and, the adaptation unit determining the change value (DA) so that such adapted corrective values (KA) are obtained that lower control deviations occur when the same values of operating variables occur later.

The second major embodiment of the control system likewise includes the status recognition unit, the precontrol value ROM and the desired value ROM described above. The second embodiment further includes: a corrective base value ROM for storing transient corrective base functions of actuating variables with the corrective base functions being addressable via values of addressing operating variables (L, dL/dt, n, TW; Z) and for determining corrective base values (KG) as a function of time; an adaptation value RAM for storing adaptation values (A) which are addressable via values of addressing operative variables (L, dL/dt, n, TW; Z); a value logic combining unit for logically combining a read out corrective base value (KG) with a corresponding adaptation value (A) to obtain a corrective value ($KA=KG\cdot A$; $KA=KG+A$) with the aid of which the precontrol values are corrected in transient operation; an adaptation unit for obtaining change values (DA) from the magnitude of control deviations between actual values of control variables determined during the duration of a transient operation and also from the magnitudes of desired values of control variables read out of the desired value ROM; an adaptation combining logic unit for logically combining an adaptation value (A) read out of the adaptation value RAM with a change value (DA) for obtaining a new adaptation value ($Anew=A\cdot DA$; $Anew=A+DA$) which is then stored in the adaptation value RAM under the same address under which the previous value was read out; and, the adaptation unit determining the change value (DA) so that lower control deviations occur with the later occurrence of the same value of operating variables.

The two juxtaposed embodiments described above have the function in common that with each transient operation, it is decided from deviations of monitored control variables whether utilized corrective values K(Z) have already been selected or not. If unwanted large deviations are determined, then adaptation is undertaken.

Adaptation is understood to be those learning operations in which corrective functions during operation of the internal combustion engine 21 (FIG. 1) are so changed that with a renewed occurrence of those operating conditions (as a consequence of which an adaptation occurred) such corrective values were emitted that the control deviations which were then observed are less than with the previous occurrence of these operating conditions.

Pursuant to the first embodiment, a corrective base value ROM is provided from which values are read out only for an initialization operation and in a corrective value RAM in which adaptation is then undertaken.

Pursuant to the second embodiment, a corrective base value ROM is likewise present from which however, there is a readout to determine each individual corrective value K(Z). The value read out in each instance is logically combined with an adaptation value which is read out of an adaptation value RAM. The adaptation values are set in an initialization operation to 1 or to 0 in dependence upon whether the above-mentioned logic operation is multiplicative or additive. Adaptation of the adaptation values occurs during operation.

Pursuant to the first variation of the first embodiment, the corrective base value ROM stores the corrective base values KG(Z) which are identical to the corrective values K(Z) as they are stored in the corrective value ROM. In the corrective value RAM each individual corrective base value KG(Z) is adapted, if required, and is then present as a directly useable adapted corrective value KA(Z).

With the second variation of the first embodiment, the corrective base value ROM stores actuating value transient functions as mathematical functions including constants corresponding thereto. The function constants are adapted in the corrective value RAM. Adapted corrective values KA(Z) are computed from these functions while considering the particular newest applicable constants. For the first variation of the second embodiment, the adaptation value RAM stores only a single adaptive value for each individual actuating value transient corrective function f(Z) filed in the corrective base value ROM.

According to the second variation and in contrast to the foregoing, an adaptation value A(Z) is stored in the adaptation RAM for each corrective base value KG(Z) in the corrective base value ROM. The variation which is the most advantageous is dependent upon the application. The variation having only one adaptation value for each correction function requires less storage space and less computation time. The variation having the stored functions requires still less storage space and is also the variation which operates with the greatest accuracy; however, this variation comparatively requires the most computation time. The variations for which all corrective values are adaptable, either directly or via an adaptation value, are compromise solutions with respect to storage capacity and computation time. With the present state of technology, they are the simplest to realize.

As soon as a transient operation begins, other desired values are suddenly read out of the desired value ROM than during the duration of the previous steady-state operation. The newly read out desired values are, however, those which were determined for the steady-state condition.

According to another feature of the invention, the control system includes a desired value corrective memory in order to already consider the presence of a transient operation on the side of the desired value. The desired value corrective memory is addressable via values of addressing operating variables and preferably via those particular values at the beginning of a transient operation. The most precise control results are then obtained when the number Z of the number of suction strokes since a transient operation is considered as an address quantity.

An especially precise adaptation of particular desired values to transient operations is then obtained when the described desired value corrective values are subjected to an adaptation process during operation of the engine.

In order to carry this out and pursuant to a further embodiment of the invention, desired value to actual value comparisons are carried out with reference to the torque of the engine. The desired value corrective values are adapted in dependence upon the detected magnitude of the control deviations.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
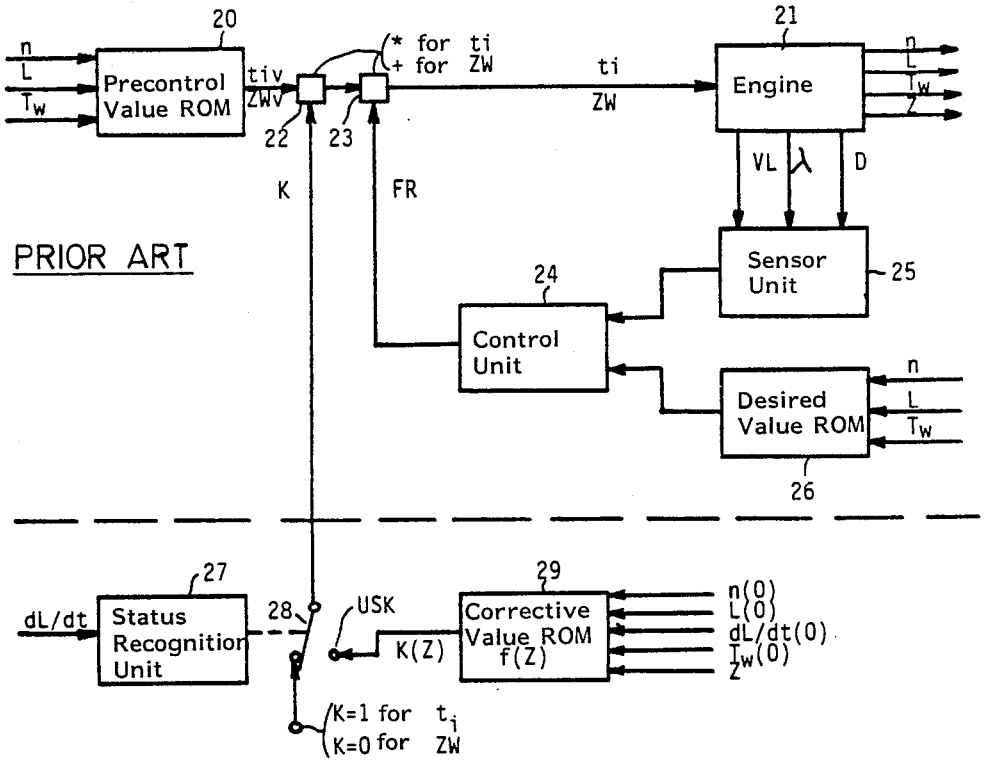
FIG. 1 is a block diagram which was described earlier and is helpful for explaining the functions of a known control system for transient operation.
Figure 3:
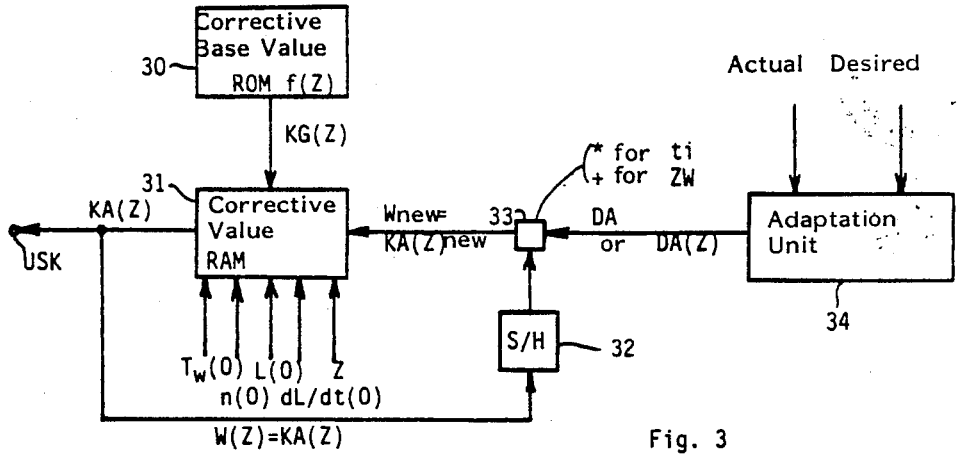
FIGS. 3 to 5 are block diagrams for explaining four basic variations of systems of the invention according to which adapted corrective values KA(Z) are obtained from actuating value transient corrective functions.
Figure 4:
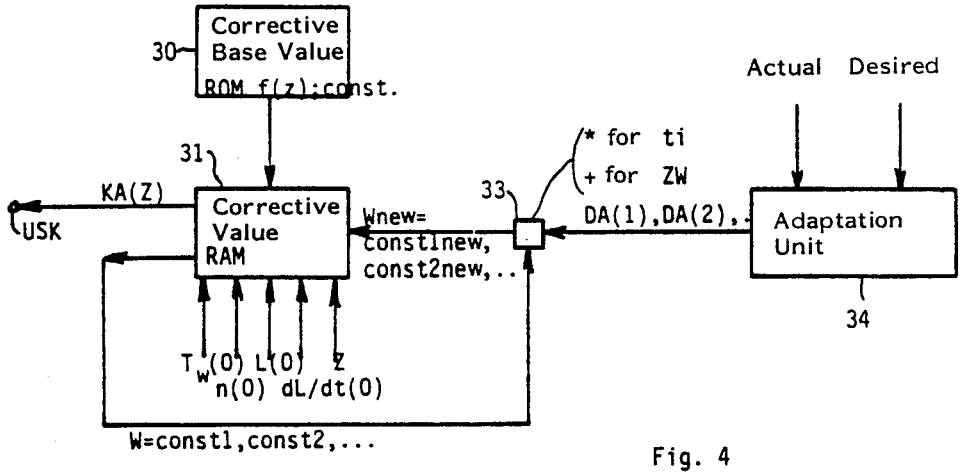
Figure 5:
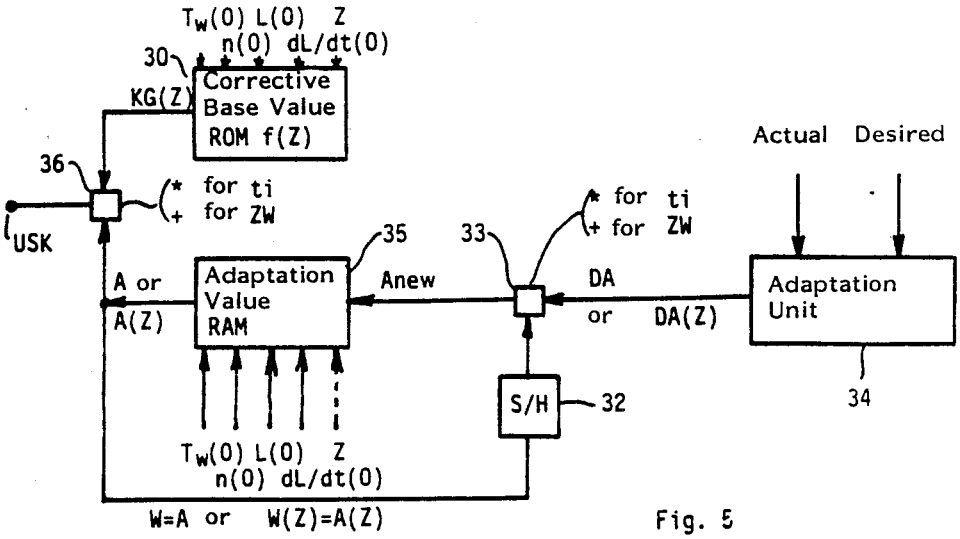

FIGS. 3 to 5 relate to that portion of a control system which is shown in FIG. 1 beneath the dashed line, that is, that portion which undertakes corrections during a transient operation. The status recognition unit 27 is omitted in FIGS. 3 to 5. The only part of the status recognition unit 27 and the selector switch 28 which is shown is the selector switch contact USK to which the selector switch 28 is switched during transient operation.

In the following, it is always assumed that the switchover occurs starting with a suction stroke Z=0 for which the load change dL/dt exceeds a threshold value and that the duration of the transient operation is fixed at Z=N=16 suction strokes.

The function group according to FIG. 3 includes a corrective base value ROM 30, a corrective value RAM 31, a sample/hold-circuit (S/H-circuit) 32, an adaptation logic unit 33 and an adaptation unit 34.

The corrective base value ROM 30 stores actuating value transient corrective functions f(Z) in a manner corresponding to corrective value ROM 29 according to the state of the art. With each initialization operation, corrective base values KG(Z) are read out of the corrective base value ROM 30 into the corrective value RAM 31. The corrective base value KG(Z) corresponds to corrective values K(Z) described above with respect to FIG. 2.

These corrective values are however subjected to an adaptation process in the corrective value RAM 31 so that adapted corrective values KA(Z) are read out from the latter. The adaptation occurs in that first a change value DA is obtained in the adaptation unit 34 by means of a desired value to actual value comparison of a controlled variable such as of the lambda value for each completed transient operation. The change value DA is supplied to the adaptation logic unit 33 in order to be there multiplicatively combined with a value W(Z). This value W(Z) corresponds to that adapted corrected value KA(Z) as it was read out of the corrective value RAM 31 at the beginning of a transient operation for the values of operating variables then present for Z=0. This value is retained by means of the S/H-circuit 32 until the end of the transient operation in order to then be available for the above-mentioned multiplicative logic operation. The computed value KA(Z)new=-KA(Z). DA is filed as a new adapted corrective value under that address from which the adapted corrective value utilized previously was read out. Even this address must be thereby retained in a memory (not shown) until the end of the transient operation.

The adaptation unit 34 can determine a change value DA(Z) for each suction stroke Z in lieu of only one single change value DA for an entire transient operation. This occurs in a manner as will be explained below with respect to FIGS. 6 and 7. The above-mentioned operations of retaining values and of the logic operations then occur separately for each suction stroke. A multiplicative logic is especially applied when the actuating variable is the injection time ti. In lieu of this multiplicative logic, an additive logic can also be utilized especially then when the actuating variable is the ignition angle ZW.

The function group according to FIG. 4, likewise includes a corrective base value ROM 30 and a corrective value RAM 31 as well as an adaptation logic combining unit 33 and an adaptation unit 34. The corrective base value ROM 30 stores time-dependent functions f(t) and constants. These functions and constants are read into the corrective value RAM 31 with each initialization operation. An adapted corrective value KA(Z) is computed from the functions and constants filed in the corrective value RAM 31 while considering the values of addressing operating variables. The functions are preferably continuous functions and the sequence number Z of the suction strokes are however discontinuous. For this reason, it is advantageous to convert the number of suction strokes into a time-equivalent value, for example, by considering the speed or by considering the crank angle since the beginning of the transient operation.

In the embodiment of FIG. 4, non-adapted corrective values KA(Z) are not newly adapted with each adaptation step; instead, the values of the filed constants are newly adapted. For this purpose, the adaptation unit 34 emits a change value (DA1, DA2 . . .) for each constant. These change values (DA1, DA2, . . .) are obtained in that the adaptation unit 34 determines how the constants should have been formed from measured control deviations so that the measured control deviation does not occur. An S/H-circuit is not required for the illustrated embodiment. It is assumed that the values of addressing operating variables are stored for the time at which a transient signal occurs or for the previous suction stroke, so that the constant values filed under the stored address can be read out, corrected or again read in at the end of the transient operation or with each new suction stroke.

The function group of FIG. 5 also includes a corrective base value ROM 30, a S/H-circuit 32, an adaptation logic combining unit 33 and an adaptation unit 34. In addition, an adaptation value RAM 35 and a value logic combining unit 36 are provided. The corrective base value ROM 30 no longer supplies values with initialization operations; instead, the corrective base value ROM 30 supplies a corrective base value KG(Z) with each suction stroke during a transient operation corresponding completely in the manner in which the corrective value ROM 29 of the known system supplied corresponding corrective values K(Z). In contrast to the values supplied with the known system, the corrective base value KG(Z) are, however, not directly used for the logic combination with precontrol values; instead, they are each first combined in the value logic combining unit 36 with an adaptation value A(Z)A which is read out of the adaptation value RAM 35 for the same values of addressing operating variables for which a corrective base value was read out. The adaptation values A(Z) are at the same time values W(Z) to be adapted in correspondence to the adapted corrective values KA(Z) in the function example according to FIG. 3. The adaptation occurs identically so that FIG. 3 may be referred to for the purpose of explanation.

Also with the function example according to FIG. 5, the variation is possible that the change value DA(Z) is not determined for each suction stroke Z in correspondence to the function example of FIG. 3; instead, only a single change DA is determined for an entire transient operation. In this case, the adaptation value RAM 35 does not store an adaptation value A(Z) for each cylinder stroke Z; instead, only an adaptation value A for each set of addressing operating variables is present in addition to which also a transient corrective function f(Z) of an actuating value is present. In this case, the adaptation value RAM 35 does not have to be addressed with the number Z of the cylinder stroke and, it is for this reason, that this addressing variable is shown only in dotted outline at the adaptation value RAM 35 in FIG. 5.

With respect to FIGS. 6 and 7, it will now be explained how change value DA(Z) is obtained for each suction stroke Z or how a single change value DA is obtained for an entire transient operation.

Figure 6:
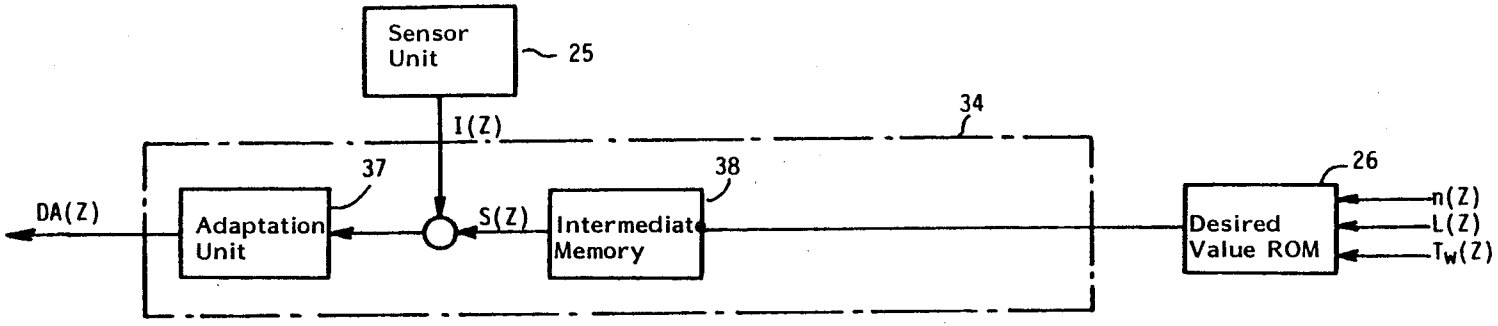
FIG. 6 is a block diagram for explaining the function of an adaptation unit wherein the change values DA(Z) are obtained which are dependent upon the number Z of cylinder strokes; and, FIG. 7 is a block diagram for explaining the function of an adaptation unit wherein only one single change value DA is obtained for each transient operation.

The adaptation unit 34 is shown in FIG. 6 as a function group within a block drawn with a broken line. The adaptation unit 34 includes an adaptation unit 37 and an intermediate memory 38. The adaptation unit 37 receives a difference signal which is formed from the difference between a desired value S(Z) and an actual value I(Z). The actual value I(Z) is supplied from the sensor unit already described with respect to FIG. 1. The desired value S(Z) does not originate directly from the desired value ROM 26 already described with respect to FIG. 1; instead, this desired value S(Z) originates from the intermediate memory 38. The reason for this is that in the embodiment, the premise is taken that the control variable is the lambda value. For the lambda value, a desired value S(Z) is determined for each suction stroke Z to which the corresponding actual value I(Z) however can be first measured after a dead time which can extend over several suction strokes.

For the correct desired value to actual value comparison, the desired value is therefore intermediately stored until the corresponding actual value is supplied by a lambda probe. The intermediate memory 38 can be dispensed with if in lieu of the injection time ti, the ignition angle ZW is controlled and if in lieu of the lambda value, the combustion condition VL is utilized as a control variable. The reason for this is that the desired value corresponding to the same work stroke is still present when the corresponding actual value appears.

If the difference signal supplied to the adaptation unit 37 shows a deviation of the actual value from the desired value for a lambda control of, for example, 2% in the lean direction, this means that the injection time ti must be selected so as to be approximately 2% higher. Correspondingly, the adaptation unit 37 fixes the change variable DA at 1.02. With this value, the adapted corrective value KA(Z) used previously is again adapted so that with the next occurrence of a transient operation having the same values of addressing operating variables, no further control deviation should occur again.

The very last example described above, is only intended to illustrate the adaptation process. Attention is called to the fact that the adaptation process can be varied in many ways. For example, tutorial progress tables can be present according to which a measured control deviation is not converted into a change value which would bring about a complete adaptation; instead, the control deviation will be processed only as weighted in correspondence to the tutorial progress resulting from the table.

Figure 7:
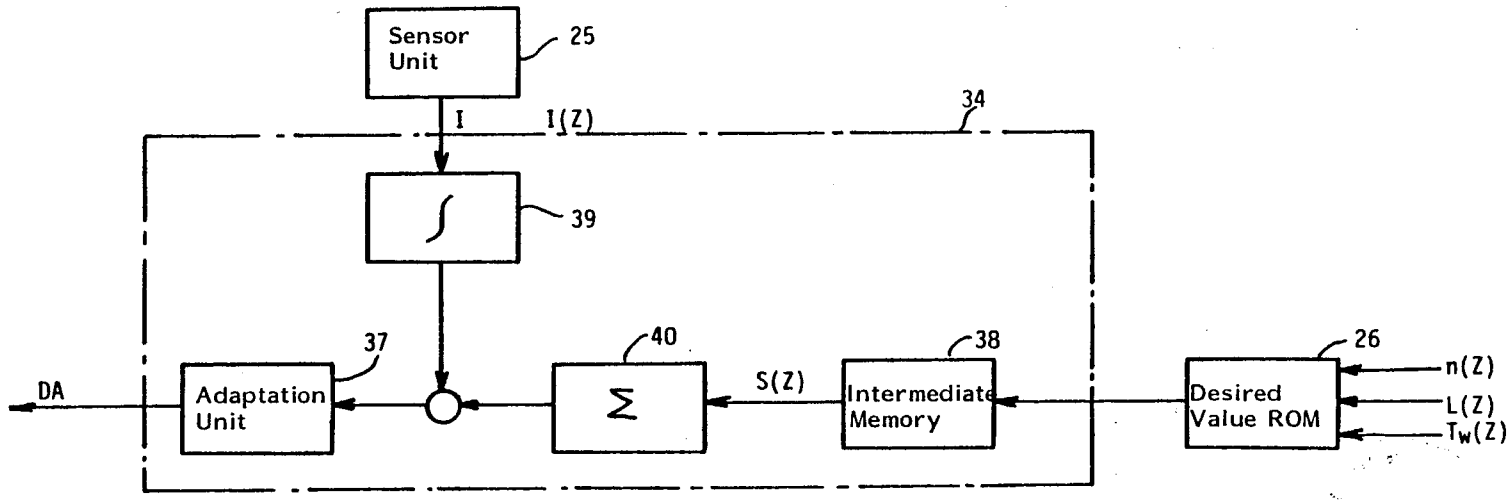

In the function unit illustrated in the block diagram of FIG. 7, the adaptation unit 34 is again shown within a block drawn with a dashed line. Within the adaptation unit 34, an actual value integrator 39 and a desired value summation unit 40 are provided in addition to the adaptation unit 37 and the intermediate memory 38. The actual value integrator 39 integrates the actual signal I over the duration of the transient operation. The actual value integrator 39 can be of analog configuration since the actual signal is, as a rule, an analog signal. If on the other hand, the integration only occurs after digitalization of the actual signal, it is advantageous to configure the actual value integrator 39 as a summation unit which adds all actual values which are scanned during the duration of a transient operation for a specific suction stroke within the series of N suction strokes. Such a summation occurs on the desired value end by means of the desired value summation unit 40 since the desired values are read out of the desired value ROM 26 in accordance with the clock frequency. A control deviation signal is again formed from the integrated or summed signals and supplied to the adaptation unit 37. The determination of a change value DA then occurs for an entire transient operation in accordance with the determination described with respect to FIG. 6 of individual change values DA(Z) for each suction stroke.

Figure 8B:
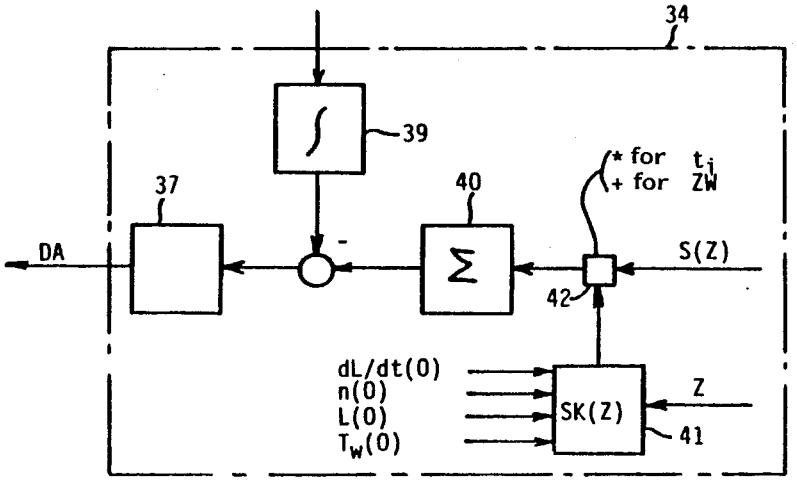
FIGS. 8*a*, 8*b*, 9*a* and 9*b* are block diagrams for explaining the function of four variations of adaptation units which consider the desired value corrective values.
Figure 8A:
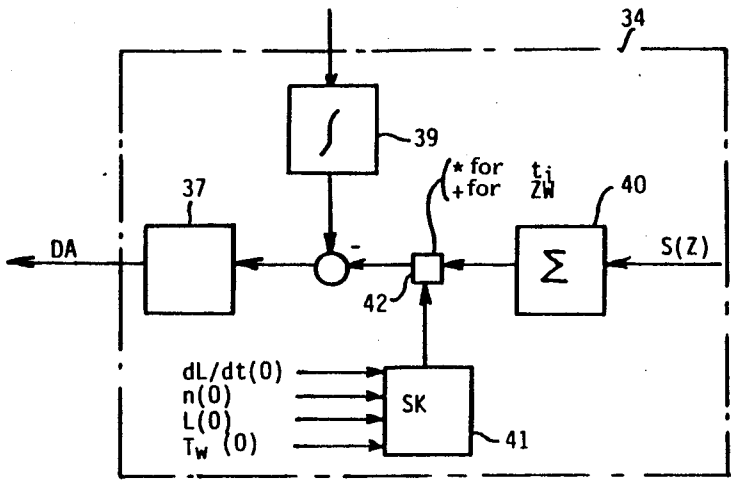
Figure 9B:
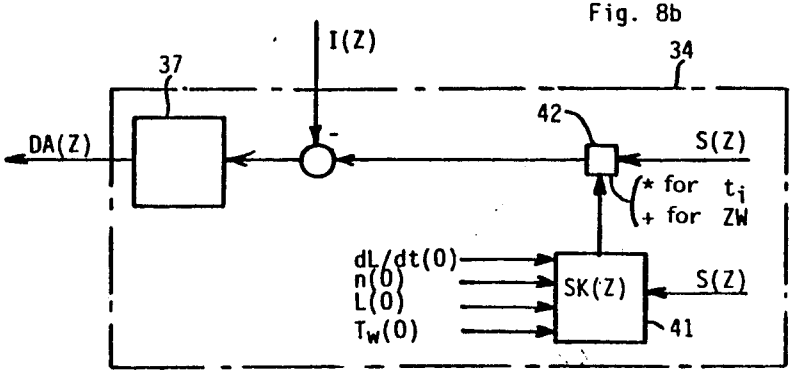
Figure 9A:
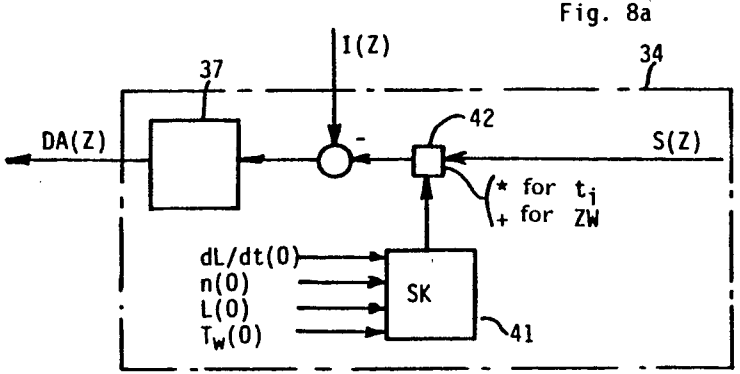

The function groups according to FIGS. 8*a* and 8*b* are extensions of the function group shown in FIG. 7 and the function groups shown in FIGS. 9*a* and 9*b* are extensions of the function group of FIG. 6. In each instance, the extension provides that the desired value S(Z), which is predetermined for steady-state operation, is corrected in order to consider the presence of transient operation.

For this reason, a desired value corrective value RAM 41 is present which either stores only a single desired value corrective value SK for a particular set of values of addressing operating variables (FIGS. 8*a* and 9*a*) or, which, in addition, considers the number Z of the work strokes during a transient operation, that is, for each set of values of addressing operating variables Z, desired value corrective values SK(Z) are stored (FIGS. 8*b* and 9*b*).

In the embodiment of FIG. 8*a*, a desired value logic combining unit 42 is provided which logically combines the one desired value corrective value SK with a desired value sum which is read out of the summation unit 40 described above with respect to FIG. 7. The corrected sum is correspondingly evaluated as the uncorrected desired value sum in the function group of FIG. 7. The result is a single change value DA for each set of values of addressing operating variables.

Figure 2:
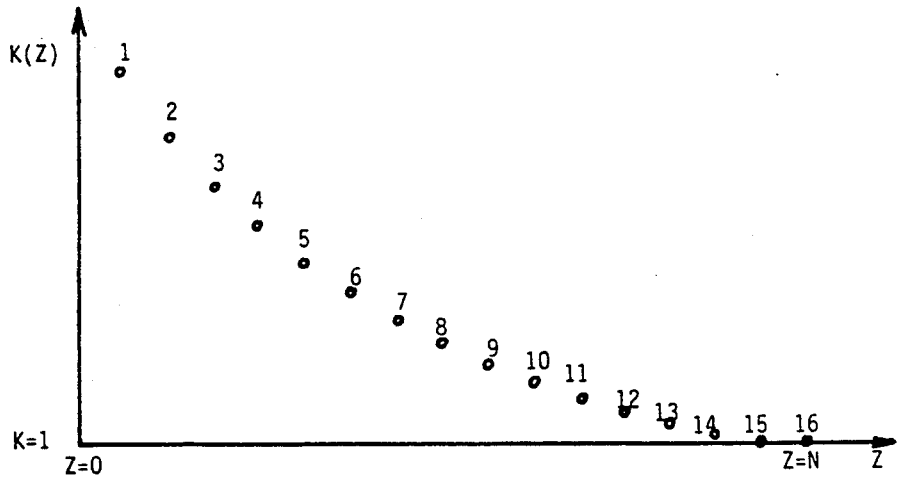
FIG. 2 is a diagram which was also discussed earlier and is directed to a transient actuating value function as it is utilized in known systems but also with the system according to the invention.

The embodiment of FIG. 8*b* differs from that in FIG. 8*a* in that a desired value logic combining unit 42 is provided which is arranged ahead of and not behind the desired value summation unit 40. This is the case because each desired value dependent upon the number Z of a suction stroke should be logically combined with a corresponding desired value corrective value ahead of the summation. The course of the corrective values SK(Z) is preferably similar to the course of the actuating value corrective value K(Z) as they are shown in FIG. 2.

The embodiments of FIGS. 9*a* and 9*b* differ from the embodiment according to FIG. 6 only in that a desired value correction occurs with the aid of a desired value logic combining unit 42 before the difference formation to an actual value I(Z) results. According to FIG. 9*a*, as already mentioned above, only one desired value corrective value is available in the desired value correction value RAM 41 for the correction; whereas, according to FIG. 9*b*, N desired value corrective values SK(Z) are filed which correspond to the number of suction strokes during a transient operation.

The described desired value logic combining units 42 logically combine either multiplicatively, for example, then when the control variable is the lambda value or additively, for example then, when the control variable is the combustion condition VL.

All measures which are taken in known control systems as well as in the present system during a transient operation serve especially to maintain the quantity of toxic exhaust gases low and assure good driving comfort without jolting vehicle movements. The last requirement transferred to accelerating operations means that when the accelerator is depressed, a jolt should be immediately noticed but for which no torque interruption should follow. For deceleration this means that a torque reduction without a jolt is expected. In practice, the control during acceleration is especially problematic. For this case, FIGS. 10 and 11 provide function examples as to how the desired value corrective value can be so adapted that virtually no torque interruptions occur.

The following are provided in order to carry out an adaptation: a torque actual value shift register 43, a torque desired value register 44, a subtraction unit 45, a learning unit 46, a multiplier 47 and an S/H-circuit 48. In addition, an actual value summing unit 49 is provided in the embodiment according to FIG. 10.

Both embodiments have in common that the torque D(1), D(2), . . . D(N) measured for each of the N suction strokes during a transient operation is stored in the torque actual value shift register 43. The embodiment of FIG. 10 serves to obtain one single desired value corrective value per transient operation. According to this embodiment of FIG. 10, the N-multiple of the torque value for the last suction stroke N, that is N * D(N), is filed in the torque desired value register.

Figure 10:
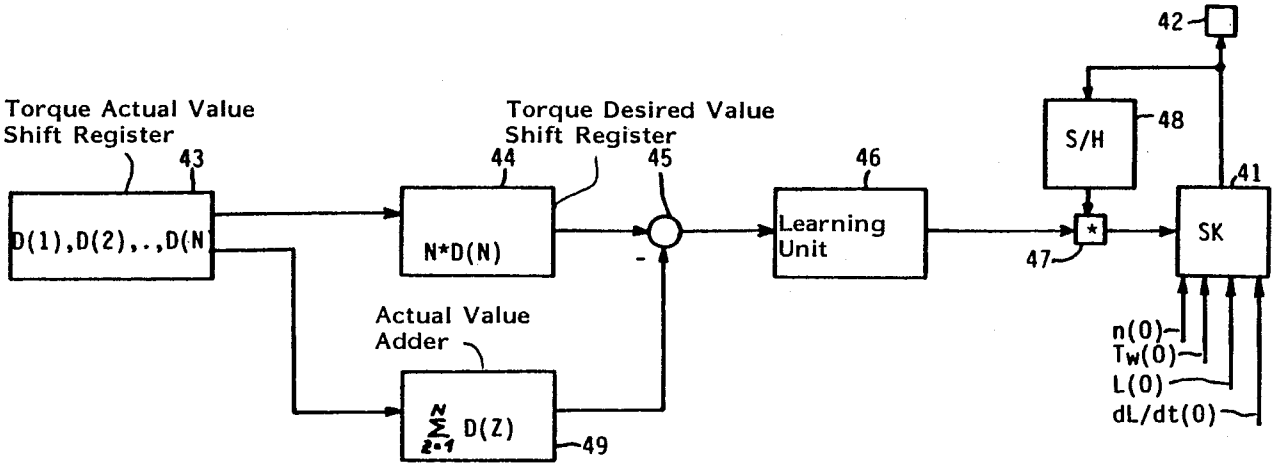
FIG. 10 is a block diagram for explaining the function of an arrangement for obtaining adapted desired value corrective values wherein only one single adapted desired value corrective value per transient function is obtained; and, FIG. 11 is a block diagram for explaining the function of an arrangement for obtaining adapted desired value corrective values wherein an adapted desired value corrective value SK(Z) is obtained for each sequence number of work strokes during a transient operation.
Figure 11:
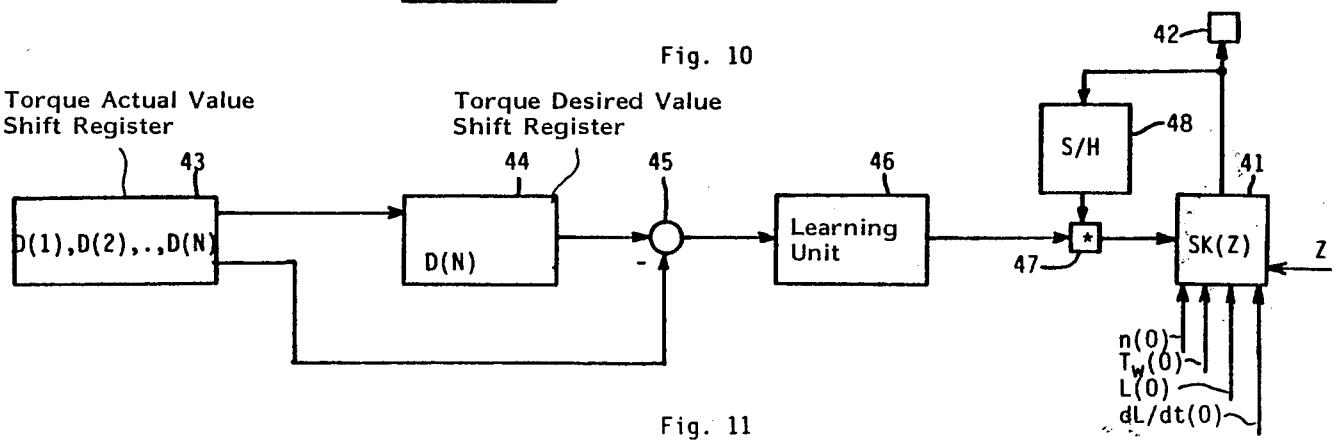

In the embodiment of FIG. 10, all N actual values are summed in the actual value summation unit 49 and the difference between the desired value from the torque desired value register 44 and the summed actual value from the actual value summation unit 49 is formed in the subtraction unit 45. The difference is supplied to a learning unit 46 which supplies a signal for increasing the desired variable corrective value SK when the difference value which is formed exceeds a threshold value. The magnitude of the corrective step can be made to be dependent upon the difference between the difference value and the threshold value or even upon values from a tutorial progress table, that is, in a manner in which conventional learning processes operate.

If the difference value remains under the threshold value, the learning unit 46 supplies a signal to slightly lower the desired value corrective value. The difference value is therefore similarly evaluated as in the case for a difference value for an anti-knock control. The value supplied by the learning unit 46 is multiplied by multiplier 47 with that desired value corrective value SK which is filed under that address in the desired value corrective value RAM 41 which results from the values of the addressing operating variables at the beginning of the transient operation. The correction with the aid of the S/H-circuit 48 occurs in the manner of the correction described with respect to FIG. 3 of the actuating value corrective value in the corrective value RAM 31.

In the embodiment according to FIG. 11 the desired value to actual value comparison does not first take place at the end of the transient operation; instead, this comparison takes place separately for each suction stroke. The learning unit 46 then processes the difference value between the desired value D(N) and a particular actual value D(Z). The desired value corrective value RAM 41 is additionally addressed with the number Z of the suction strokes so that it is possible to adapt a total of N desired value corrective values SK(Z) per transient operation.

All the RAMs described above can be configured as volatile or as non-volatile read-write memories. However, it is advantageous to use non-volatile RAMs (NoV RAM) since then the adapted values are not lost with each switch-off of the voltage and it is not necessary that another initialization process and a renewed adaptation take place for each switch-on of the voltage. An initialization and adaptation from the beginning is then only necessary for the first operation and may then be required when a monitoring circuit supplies an error signal when this monitoring circuit monitors the function of a non-volatile memory.

It is understood that the foregoing description is that of the preferred embodiments of the invention and that various changes and modifications may be made thereto without departing from the spirit and scope of the invention as defined in the appended claims.

What is claimed is:

1. Control system for adjusting an operating variable of an internal combustion engine during transient operation with the operating variable being utilized as an actuating variable, the control system comprising:

a status recognition unit for detecting whether transient operation is present from a starting time point and for supplying a transient signal at said time point, said status recognition unit making the detection in dependence upon the value of the change (dL/dt) of a load-dependent operating variable (L);

a precontrol value ROM for storing precontrol values (tiv, ZWv) of actuating variables with said precontrol values (tiv, ZWv) being specified for steady-state operation and which are addressable via values of addressing operating variables (L, n, Tw);

a desired value ROM for storing desired values for an operating variable utilized as a control variable (Lambda, VL) with the desired values being specified for the transient operation and being addressable via values of addressing operating variables (L, n, Tw);

a corrective base value ROM for storing transient corrective base functions of actuating variables with said corrective base functions being addressable via values of addressing operating variables (L, dL/dt, n, Tw; Z);

a corrective value RAM for modifiably storing the transient base functions of actuating variables for the time dependent determination of corrective values, said transient base-functions being retrieved in an initialization operation from said corrective base value ROM for respective corresponding values of addressing operating variables;

an adaptation unit for obtaining change values (DA) from the magnitude of control deviations between actual values of control variables determined during the duration of a transient operation and also from the magnitude of desired values of control variables read out of said desired value ROM;

an adaptation logic combining unit for logically combining a value (W) read out of said corrective value RAM with a change value (DA) for obtaining an adapted value (Wnew), which is then stored under the same address in said corrective value RAM with which the previous value was read out; and, said adaptation unit determining said change value (DA) so that such adapted corrective values (KA) are obtained that lower control deviations occur when the same values of operating variables occur later.

2. The control system of claim 1, wherein said corrective base value ROM stores said transient base function of said actuating variables as mathematical function equations with corresponding function constants and said corrective-value RAM stores said transient corrective functions of said actuating variables as mathematical function equations with corresponding function constants; and, said values (W) being function constants with said values (W) being read out of said corrective value RAM and logically combined with a change value (DA).

3. The control system of claim 1, wherein said corrective base value ROM stores said transient corrective base functions of said actuating variables as sequences of respective N corrective base values KG(Z) and said corrective value RAM stores said transient functions of said actuating variables as sequences of respective N corrective values K(Z) with the number (Z) of the suction strokes serving as a sequence counter starting with the transient signal; and, said corrective values read out of said corrective value RAM being the values W(Z) which are logically combined with change values (DA).

4. The control system of claim 3, wherein all N corrective values K(Z) of a desired-value transient corrective function are logically combined with a single change value (DA) after the transient operation is ended with said change value (DA) being obtained at the end of said transient operation whereafter all of said N corrective values are stored as new corrective values in said corrective value RAM.

5. The control system of claim 3, wherein each of said N corrective values K(Z) of a desired-value transient corrective function addressed for a transient operation is logically combined with a change value (DA) and then stored in said corrective value RAM as a newly adapted corrective value with said change value (DA) being obtained for each suction stroke.

6. The control system of claim 5, wherein said adaptation unit determines, for each suction stroke (Z), the control deviation between the corresponding actual values I(Z) of the control variables and the corresponding control desired value S(Z) for obtaining a change value DA(Z).

7. The control system of claim 4, comprising:

an actual value integrator for integrating the actual values of the control variables over the duration of a transient operation with the integrated value being supplied to said adaptation unit as an actual value; and, a desired value adder for adding the desired values of the control variables over the number (N) of the suction strokes during a transient operation with the added value being supplied to said adaptation unit as a desired value.

8. The control system of claim 6, comprising:

a desired variable corrective value RAM for storing transient corrective values (SK) of desired variables, said transient corrective values (SK) being addressable via values of addressing operating variables (L, dL/dt, N, Tw; Z); and, a desired value logic combining unit for logically combining desired values read out of said desired value ROM with transient corrective values of desired variables.

9. The control system of claim 8, wherein: said desired variable corrective value RAM stores a single desired variable corrective value (SK) for each one of a plurality of sets of values of addressing operating variables at the beginning of a transient operation.

10. The control system of claim 8, wherein: said desired variable corrective value RAM stores a sequence of N actuating variable corrective values SK(Z) for each one of a plurality of values for addressing operating variables at the beginning of a transient operation with the number (Z) of the suction strokes at the beginning of the transient operation serving as a sequence counter.

11. The control system of claim 9, comprising:

a torque actual value shift register for storing a torque value (D(1), D(2) . . . . D(N)) for each of the N suction strokes during a transient operation;

a torque desired value register for storing the N-multiple of the torque value D(N) at the last suction stroke for the duration of the transient operation;

an actual value adder for adding all N torque actual values to a sum actual value;

a subtraction unit for subtracting said sum actual value from the torque desired value for obtaining a difference value; and, a learning unit for supplying a signal for increasing the desired variable corrective value (SK) when said difference value exceeds a desired value and for supplying a signal for lowering said desired value corrective value when said difference value drops below the threshold value.

12. The control system of claim 10, comprising:

a torque actual value shift register for storing a torque actual value (D(1), D(2) . . . . D(N)) for each of the total of N suction strokes during a transient operation;

a torque desired value register for storing the torque value as the torque desired value D(N), said torque value being measured at the last suction stroke N of the transient operation;

a subtraction unit for forming a torque difference value for each torque actual value D(Z) by subtraction from the fixed torque desired value; and, a learning unit for supplying a signal for increasing the actuating variable corrective value SK(Z) corresponding to the same suction stroke when the difference value for a particular suction stroke (Z) exceeds a threshold value; and, for supplying a signal for reducing the actuating-variable corrective value when the difference value for a particular suction stroke (Z) exceeds the threshold value.

13. The control system of claim 1, wherein the duration of a transient operation is determined by a predetermined number N of suction strokes.

14. The control system of claim 13, wherein said number N=16.

15. The control system of claim 1, wherein: said actuating variable is the injection time (ti) and the control variable is the air ratio (lambda); and, each of said logic combining units combines multiplicatively.

16. The control system of claim 1, wherein: said actuating variable is the ignition angle (ZW) and the control variable is the combustion condition (VL); and, each of said logic combining units combines additively.

17. A control system of claim 1, wherein: said addressing operating variables include at least the speed (n), the air charge (L), the load change (dL/dt) and the engine temperature (Tw).

18. The control system of claim 1, wherein: at least a portion of the memory units and the function units being constituted by parts and functions of a microcomputer.

* * * * *